United States Patent [19]

Robertson

[11] 4,040,938

[45] Aug. 9, 1977

[54] ELECTRODE ARRANGEMENT FOR ELECTROCHEMICAL CELLS

[76] Inventor: Peter Murday Robertson, 19 Bruttenerstrasse, Oberwil, Switzerland

[21] Appl. No.: 559,605

[22] Filed: Mar. 18, 1975

[30] Foreign Application Priority Data

| | | |
|---|---|---|
| Apr. 1, 1971 | Germany | 2415784 |
| Jan. 30, 1975 | Germany | 2503819 |

[51] Int. Cl.[2] ..... C25B 3/02; C25B 11/02; C25B 13/00

[52] U.S. Cl. ..... 204/283; 204/78; 204/79; 204/131; 204/260; 204/272

[58] Field of Search ..... 204/260, 206, 272, 280, 204/301, 283, 286, 78, 79, 80, 131

[56] References Cited

U.S. PATENT DOCUMENTS

| | | | |
|---|---|---|---|
| 2,741,595 | 4/1956 | Juda | 204/260 X |
| 3,686,088 | 8/1972 | Kashii | 204/180 R |
| 3,859,195 | 1/1975 | Williams | 204/272 |
| 3,923,629 | 12/1975 | Shaffer | 204/260 |

*Primary Examiner*—Arthur C. Prescott
*Attorney, Agent, or Firm*—Wallenstein, Spangenberg, Holtes & Strampel

[57] ABSTRACT

Electrode arrangement for electrochemical cells. A deformable sandwich structure (working electrode, insulator, secondary electrode, insulator) forms a primary electrode arrangement. A three-dimensional structure can be formed by rolling up the primary sandwich structure around and axis. The shapes and material structures of electrodes and insulators co-operate with each other to enable axial and/or radial flow of an electrolyte which is pumped through the electrode roll. With such electrode rolls a high ratio of electrode surface to cell volume can be attained. Furthermore, by mounting one or more of the electrode rolls on a hollow axle and pumping the electrolyte through orifices of the axle from its interior into the electrode rolls, the scale-up of current and voltage of a cell is considerably facilitated and advantageously achieved.

10 Claims, 22 Drawing Figures

ELECTRODE ARRANGEMENT FOR ELECTROCHEMICAL CELLS

BACKGROUND OF THE INVENTION

This invention relates to an electrode arrangement for electrochemical cells.

A very important component of an electrochemical cell is the electrode arrangement contained in it. Since the electrochemical reactions take place at an electrode surface, a major design consideration is to obtain a high electrode area in as small a cell volume as is practicable.

Conventional cell designs have flat electrodes, made of whole sheets or plates, which are either taken in pairs (anode and cathode) or in multiples as in the filter-press design. A disadvantage of this conventional electrode design is the relatively low electrode area per unit cell volume. This limitation has been succesfully overcome with porous or particulate electrode (British Chemical Engineering, Vol. 16, No. 2/3, Feb./Mar., 1971, pp. 154–156, p. 159), but other difficulties have introduced. These include the difficulty to maintain a non-uniform potential and current density distribution within the electode system itself.

SUMMARY OF THE INVENTION

An object of the present invention is therefore to provide an electrode arrangement for electrochemical cells with which a high ratio of electrode area to cell volume and a uniform potential and current distribution within the electrode arrangement can be attained. Further objects of the invention are to simply cell construction and to minimise materials used so as to minimise cost.

According to this object the present invention provides an electrode arrangement for electrochemical cells comprising a sandwich arrangement of:

at least two electrodes made from deformable material, first insulating means for preventing direct electrical contact between the electodes, and second insulating means for preventing direct electrical contact between one of the electrodes and other electrodes or other conducting parts of the electrochemical cell, the sandwich arrangement of electrodes and insulating means forming a deformable electrode arrangement, and the electrodes and the insulating means having shapes and material structures which co-operate with each other to enable the flow of an electrolyte through the electrode arrangement.

In a preferred embodiment of the invention the sandwich arrangement is rolled up around a geometrical axis. This form given to the electrode arrangment enables to attain at the same time a high ratio of electrode surface to cell volume and an homogeneous distribution of both current and potential difference within the electrode arrangement.

A preferred use of the electrode arrangement according to the invention is for oxidizing diaceton-L-sorbose to diaceton-L-ketogulonic acid.

The electrode arrangement according to the invention can also be used for making an electrochemical cell of high capacity, with which the following technical aims can be attained:

a. very high admissable values of the operating voltage and/or current;

b. simple distribution of the electrolyte into the electrode system;

c. minimisation of the construction materials used;

d. simple design making possible mass-production of electrode arrangements and electrochemical cells.

This is achieved with an electrode arrangement comprising at least one electrode roll formed by rolling up the above sandwich electrode arrangement (provided by the instant invention) around a hollow axle, which has orifices at certain positions to enable the electrolyte to flow from the interior of the hollow axle into the electrode roll.

DESCRIPTION OF THE PREFERRED EMBODIMENT

Figure 1:
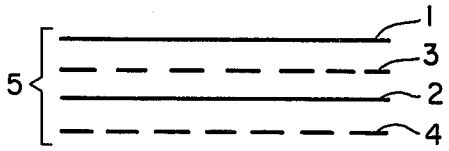
FIG. 1 shows a schematic cross section of an electrode arrangement according to the invention.

As schematically shown in FIG. 1, an electrode arrangement 5 according to the invention comprises a sandwich arrangement of at least two electrodes 1, 2 made from deformable material, first insulating means 3 which prevent a direct electrical contact between the electrodes, and second insulating means 4 which prevent direct electrical contact between one of the electrodes and other electrodes or other conducting parts (e.g. a cell-container) of the electrochemical cell wherein the electrode arrangement is incorporated.

The materials for the electrodes 1, 2 and the insulating means 3, 4 are chosen in order to make a deformable electrode arrangement 5. The materials for the electrodes and the insulating means have shapes and material structures which co-operate with each other to enable the flow of an electrolyte through the electrode arrangement.

For using the electrode arrangment according to the invention in an electrochemical cell, it is convenient to give the electrode arrangement a form enabling to get a maximum ratio of electrode surface to cell volume. This design criterion is satisfied by the electrodes roll 6 shown in FIG. 2, which is formed by rolling up the electrode arrangement shown in FIG. 1 around a geometrical axis A–A'.

In the drawings, the electrodes are shown to be rather loosely wound. Although this could be the case in certain applications, e.g., when there is considerable gas evolution from one or more electrodes, for most purposes the electrodes 1,2 and insulating layers 3,4 are normally wound tightly around a central core 30 (FIG. 5,6) to obtain an high an electrode surface area within the fixed volume of the cell is required.

The electrode roll 6 is preferably contained in a vessel (not shown in FIG. 2) which has the necessary inputs and outputs and which is suitably of cylindrical construction.

Figure 2:
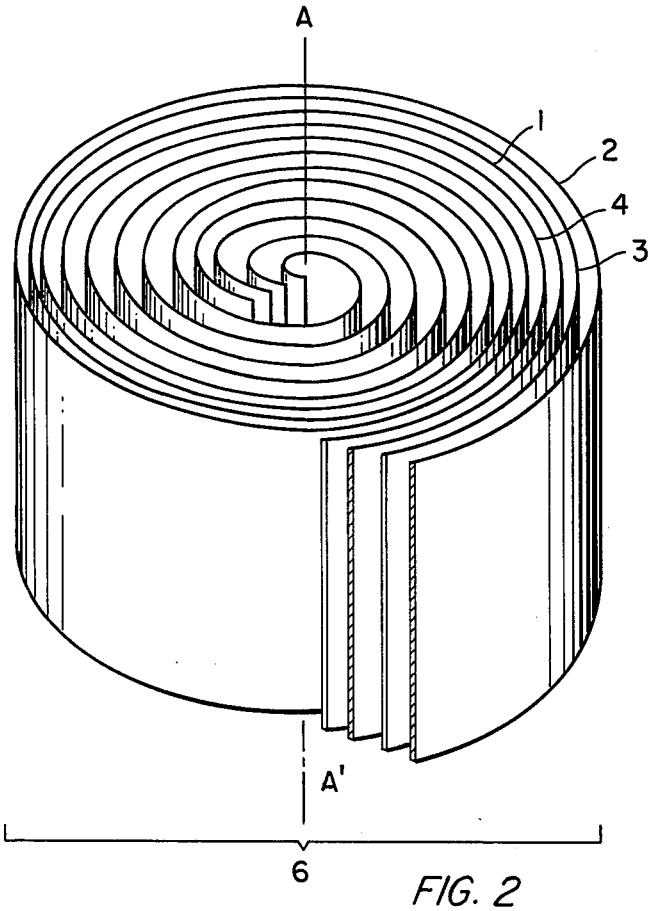
FIG. 2 shows a schematic perspective view of a preferred form given to the electrode arrangement of FIG. 1 for using it in an electrochemical cell.
Figure 3:
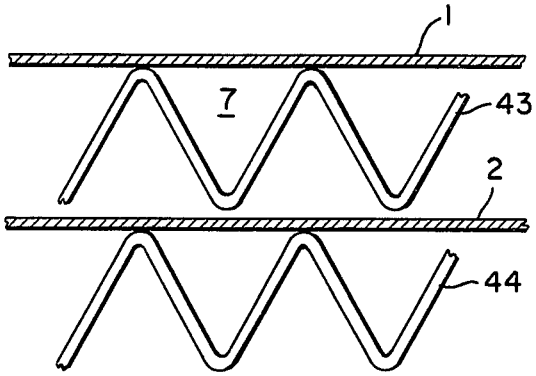
FIG. 3 shows a cross-section of a preferred embodiment of the electrode arrangement of FIG. 1.
Figure 4A:
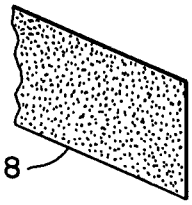
FIG. 4 shows a schematic representation of some material structures that can be used for the electrodes (8, 9, 10, 11) and for the insulating materials (8, 10, 11)
Figure 4B:
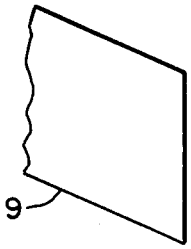
Figure 4C:
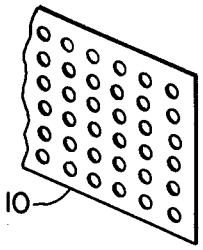
Figure 4D:
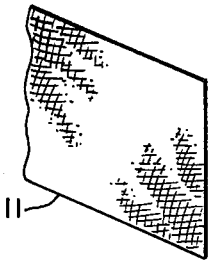

As shown in FIG. 3, the insulating means 3,4 separating the electrodes 1,2 in FIG. 2 must serve several pruposes. The first one is to electrically insulate electrodes at different potentials from each other. The second one is to co-operate with the electrodes 1,2 to form cavities 7 to enable the flow of an electrolyte through the electrode arrangement. An additional function of the insulating means can be to separate solutions around different electrodes.

The material for the insulating means can be any chemically inert substance which has a suitable form and material structure. As shown in FIG. 4, the insulating means can be made, e.g. from porous 8 or perforated sheets 10, woven synthetic materials or woven glass fibre 11. The insulating means can also be made from an ion-exchange membrane.

As stated above, besides preventing direct electrical contact between electrodes at different potentials, a second function of the insulating means is to co-operate in providing cavities 7 within the electrode arrangement. These two functions can be achieved with separate components, in which case any of the aforementioned materials for use as an insulator can also be used for forming the cavities 7 between the electrodes. On the other hand, specifically constructed single materials, e.g., rippled sheets 43,44, as shown in FIG. 3 or woven materials 11, can be used for performing both functions.

The material for the construction of the electrodes should have good electrical conductivity, suitable electrochemical properties and good corrosion properties, which satisfy the requirements of the particular application. Most metals are suitable e.g. platinum, gold, palladium, copper, nickel, lead, tin, cadmium or any other suitable metal or alloy thereof. Non-metalic materials can also be used. For instance, carbon which is in a flexible form, e.g. a deposit on an electrically conducting substrate, carbon filaments woven filaments, or felts, can be used. The electrode may also have special coatings, e.g. oxidised ruthenium or lead dioxide or oxidised nickel hydroxide. As represented in FIG. 4, the electrode rolls can be constructed from sheet materials, perforated sheets 10 or gauzes 11.

The vessel holding the electrode roll can be constructed from any chemically inert material (inert to the electrolyte and under the operating conditions employed), that has a suitable mechanical strength.

An electrolyte, which can be a solution or a pure liquid or a mixture or emulsion of solutions or liquids or both, is the feed-stock for the electrolytic cell described hereinafter.

Figure 5:
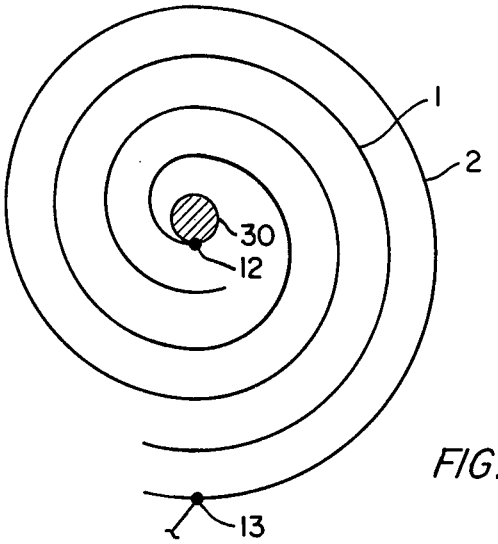
FIG. 5 shows a schematic top view of the electrode arrangement of FIG. 1, wherein each electrode has a single electrical connnection (the insulating materials are not shown)

During operation of the cell, the electrolyte must be made to enter the cavities 7 between the electrodes. This flooding of the cavities may be achieved by running the electrolyte into the electrode-roll in either of two main directions or a combination of these two. The first main direction along which an electrolyte can be fed into the roll is axially, i.e., along the direction of the axis A-A' of the roll. In this case, it is necessary to seal (electrolyte impermeable) the outside of the electrode roll to the inside wall of the container. This is to force the electrolyte to flow through the electrode roll and not around the outside. The second main direction to feed an electrolyte into the roll is radially either inwards or outwards from the central core 30 (FIG. 5,6). In this second case the central core of the roll has to be hollow or to provide some other form of pathway for the electrolyte to enter or be removed from the centre. In addition the electrode materials and the insulating means must be electrolyte permeable. As schematically represented in FIG. 4, they could either be porous 8, perforated sheets 10 or gauzes 11.

Electrical energy can be supplied to the electrode roll 6 (FIG. 2) by means of simple and suitable connections. In the following some forms of electrical connection are described.

FIG. 5 shows a shematic top view of a electrode roll with two electrodes. Point 12 represents the electrical connection of the electrode and the axle 30. Point 13 represents the connection of the second electrode 2 and the cell container. Electrical power is fed to the electrode roll via the axle 30 and the cell container. This form of electrical connection is suitable, when the voltage drop over the whole length of the rolled electrodes is negligible for the electrochemical process being performed.

Figure 6:
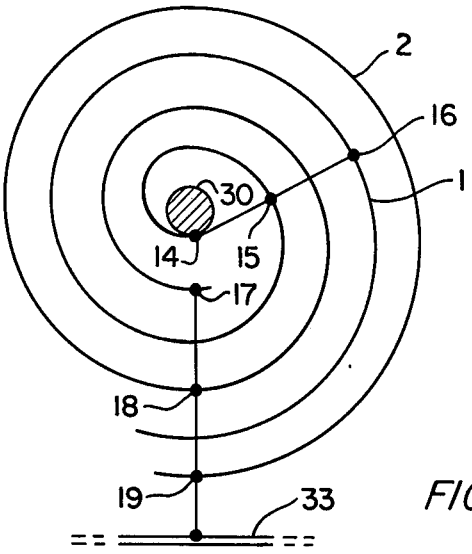
FIG. 6 shows a schematic top view of the electrode arrangment of FIG. 1, wherein each electrode has multiple electrical connections (the insluating materials are not shown)

FIG. 6 shows a second form of electrical connection with which the electrical power is fed to each electrode at several positions along their length by making power connections to the edges of the coiled electrodes, e.g. at points 14, 15, 16 and, respectively, 17, 18, 19. This second form of electrical connection is suitable for relatively high current inputs, in which case the potential drop along the electrode lengths may be prohibitively high.

Figure 7:
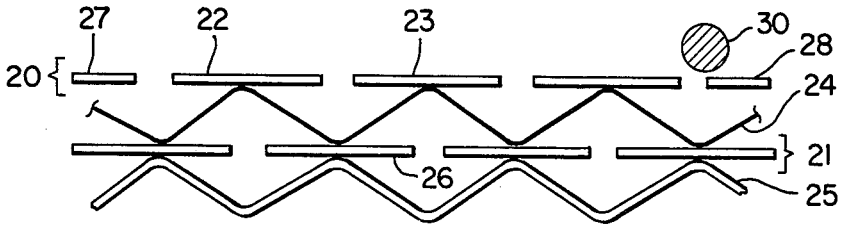
FIG. 7 shows a schematic representation of a cross-section of an electrode arrangement with segmented electrodes for bipolar operation (prior to rolling up)

A third way of feeding electrical power to the electrodes can be achieved with an electrode arrangement for bipolar operation. FIG. 7 shows a schematic cross-section of an electrode arrangement for bipolar operation, prior to rolling it around an axle 30. The electrode layers 20, 21 are formed of conducting segments which are electrically insulated from each other. Each segment 26 of one electrode layer 21 overlaps two halves of adjacent segments 22, 23 of the other electrode layer 20. In bipolar operation, the electrical power is fed by applying the operating voltage between the end segments 27, 28 of the electrode arrangement. As with all bipolar electrode arrangements the total current flowing through the electrode arrangement is the same as for a bipolar arrangement with only one pair of electrodes, while the operating voltage is equal to the potential difference between a working electrode segment and its corresponding secondary electrode segment times the number of such electrode segment pairs, i.e. working and secondary electrode segments.

To achieve efficient bipolar operation it is necessary to employ an insulating separator 24 that enables ionic conduction (solution permeable) between the electrode layers 20 and 21 and an insulating separator 25 that prevents both ionic and electronic conduction between different pairs of electrode layers. This is of importance when the sandwich shown in FIG. 7 is rolled up around the axis 30. When only a pair of electrode layers is used, separator 25 serves to isolate this pair from undesirable electric contacts, e.g. from the cell container.

The use of an electrode arrangement according to the invention is described with reference to FIG. 8, which shows a cross-section of an electrolytical cell along its central axis. The electrode arrangement 32 comprises one anode and one cathode. Each electrode is a nickel sheet 3000 × 150 × 0.1 mm. The separator between the electrodes is made of a synthetic cloth. The core of the coiled electrode arrangement is a solid nickel rod 31. The electrode sandwich 32: nickel foil, separator, nickel foil, separator is rolled up tightly around the nickel rod 31. The electrode roll 31, 32 is lodged in a cell container, which comprises a stainless cylinder 34, an upper PVC cover 35 that lodges the upper end of the nickel rod 31 and a perforated PVD disc 36, which is screwed to the lower end of the nickel rod. The nickel rod 31 makes electrical contact with the anode sheet of the roll is provided with a connection bolt 37 to serve as current feeder to the anode. The cathode sheet of the roll makes a tight press fit with cylinder 34, which is provided with a connection bolt 38 to serve as current feeder to the cathode. The diameter of fthe central nickel rod 31 is 22 mm and the inside diameter of the container 60 mm. In operation the electrolyte is pumped into the cell at an inlet 39 at the bottom of the container and through the roll 32 in a direction parallel to the axis of the nickel rod 31. The electrolyte leaves the cell at an outlet 40 near the top of the cell container.

Three examples of the electrolyte processes, e.g. electrochemical oxidations, that can be performed with the cell described above are given below:

Oxidation of ethylamine to acetonitrile:

A solution 0.85 M in ethylamine and 1 M in potassium hydroxide is pumped continuously through the cell. Electricity is applied to the cell and the current density is adjusted at 2,33 mA/cm$^2$ (the electrode area is about 9000 cm$^2$). The cell voltage during the electrolysis lies in the range of 1.8 to 2.0 Volt. After 4 hours the electrolysis is stopped and the material yield of acetonitrile lies about 67.8%.

Oxidation of benzyl alcohol to benzoic acid:

The electrolysis solution (emulsion) is 0.5 mole benzyl alcohol, 1.0 mole potassium hydroxide and 5 g sebacic acid in 500 ml water. The sebacic acid is added to obtain an emulsion of the immiscible benzyl alcohol in water. This solution is pumped continuously through the cell and a current of 10 Amperes is applied to the cell for 260 minutes. The solution is then adjusted to pH = 1 and a precipitate of benzoic acid containing some sebacic acid is obtained. The weight of the dried precipitate lies about 25.8 g. Pure benzoic acid is obtained by distillation of the crude product. The yield lies about 8.0 g.

The nickel electrodes of the electrolytic cell described above can be pre-treated by electrodeposition of a layer of nickel oxide. This can be done as follows. An aqueous solution: 0.1 M nickel sulphate, 0.1 M sodium acetate and 0.005 M sodium hydroxide is pumped through the cell continuously. A current of 50 Amperes is applied to the cell for 5 seconds, the polarity of the supply is then reversed and 50 Ampere of the opposite polarity are applied to the cell for 5 seconds. This procedure is repeated 5 times.

The cell with pre-treated electrodes as described above can be used to oxidize diacetone-L-sorbose (DAS) to diacetone-L-ketogulonic acid (DAG). For this, 500 ml of a 30% solution of DAS and 2 M potassium hydroxide is pumped through the cell continuously while a current of 50 Amperes is applied. The electrolysis is continued until significant amounts of oxygen evolve from the anode. The solution is then cooled to 0° C and brought slowly to pH = 1. DAG precipitates out. It is filtered off, dried an weighed. A 95% material yield is obtained.

The advantages of an electrode arrangement according to the invention are as follows:

The sandwich structure of the electrode arrangement 5 (FIG. 1) enables use of very thin and even delicate electrode materials.

Three-dimensional electrode arrangements like the electrode roll 6 can be made from the basic electrode arrangement 5 depicted in FIG. 1. In this way a mechanically rigid and self-supporting electrode arrangement is made from a deformable one. Such compact electrode rolls enable reaching a high ratio of electrode surface to cell volume, when the electrode roll is placed in a suitable cell-container.

When the electrolyte flows axially through the electrode roll, the unusual ratio of path width (the length of the electrodes) to path length (the width of the electrodes) enables to minimise the electrolyte residence time within the cell.

With the electrode arrangement 5 according to the invention, it is possible to make very small inter-electrode gaps. This enables to minimising the volume of inactive electrolyte and the corresponding power losses. Convection conditions at the electrodes can also be improved by use of small interelectrode gaps, provided gas is developed at least at one electrode.

An important advantage of the electrode arrangement according to the invention is that uniform mass transport conditions are obtained as follows: The flow of electrolyte through the separator layers 3, 4 can be employed to introduce turbulence into the electrolyte stream. The turbulence given to the electrolyte flow in passing through e.g. a woven cloth separator maintains uniform mass transport conditions over the whole electrode surface.

Furthermore, the electrode arrangement 5 according to the invention makes it possible to supply electrical power to the electrodes in such a way that a very uniform distribution of current and potential difference can be attained within the electrode arrangement.

Use of an electrode arrangement according to the invention is by no means limited to electroorganic processes, but extends to a plurality of other electrochemical processes.

Figure 8:
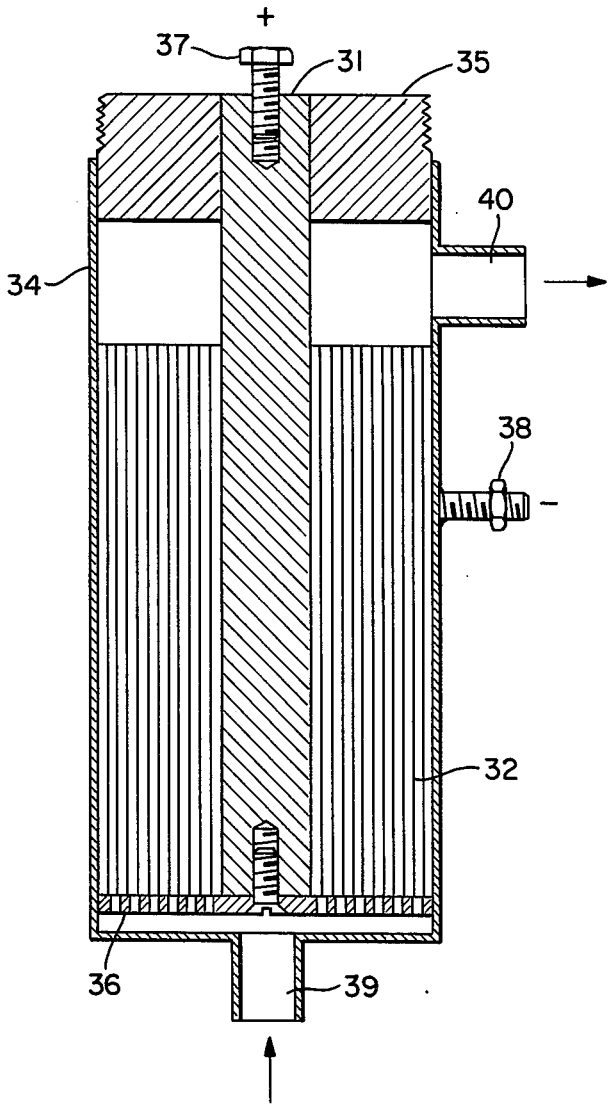
FIG. 8 shows a schematic cross-section view of an electrolyte cell which contains an electrode arrangement according to the invention.

As already mentioned above scale-up of the current with the simple electrode roll of the cell shown in FIG. 8 is limited by potential drops along the electrodes.

In the following, three preferred embodiments of electrode arrangements according to the invention are described, with which inter alia the above scale-up limitation can be overcome.

Figure 9:
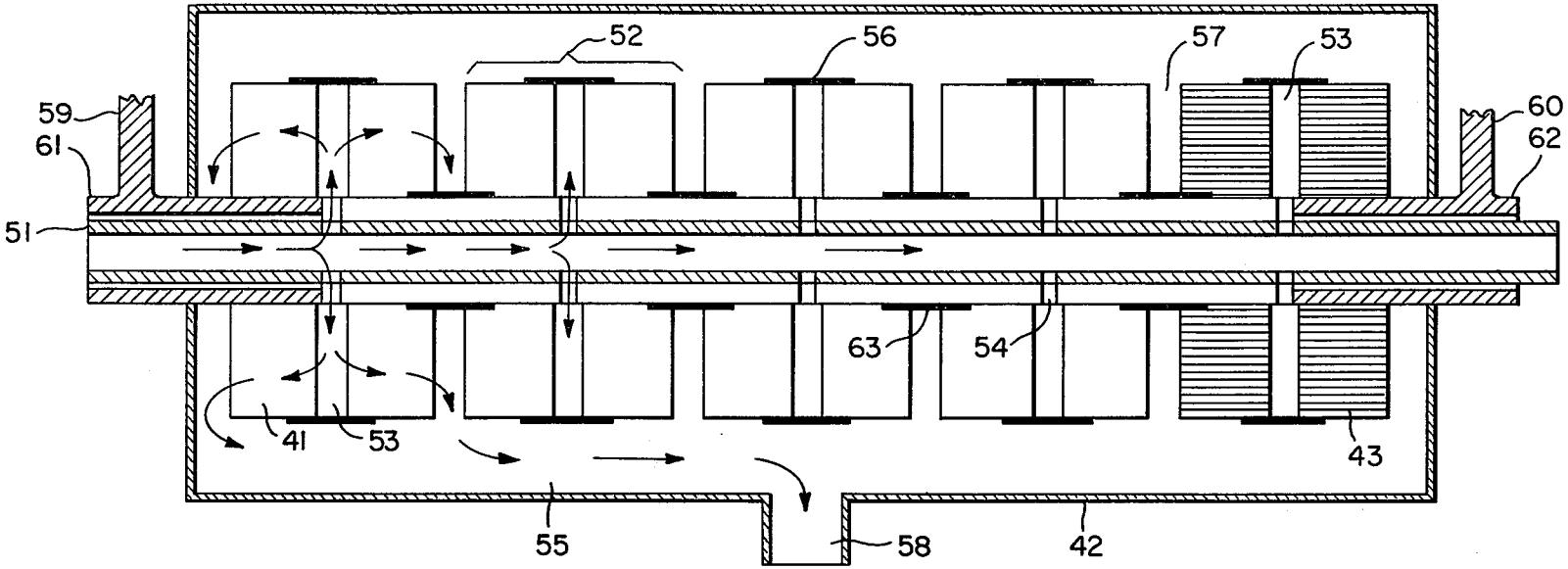
FIG. 9 shows a schematic cross-section of a first embodiment of an electrochemical cell which comprises several electrode rolls of the type shown in FIG. 2.
Figure 10:
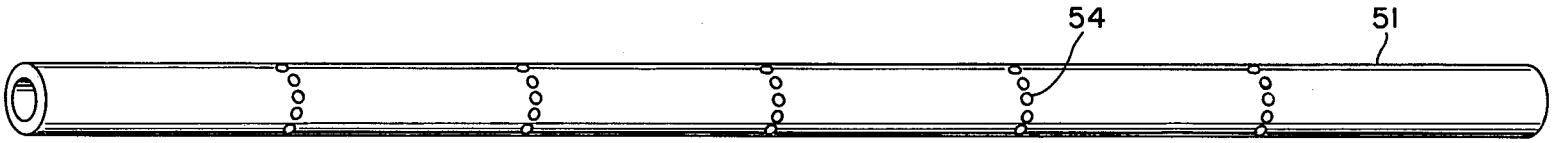
FIG. 10 shows a perspective view of a preferred form of the axle of the electrochemical cell shown in FIG. 9.
Figure 11:
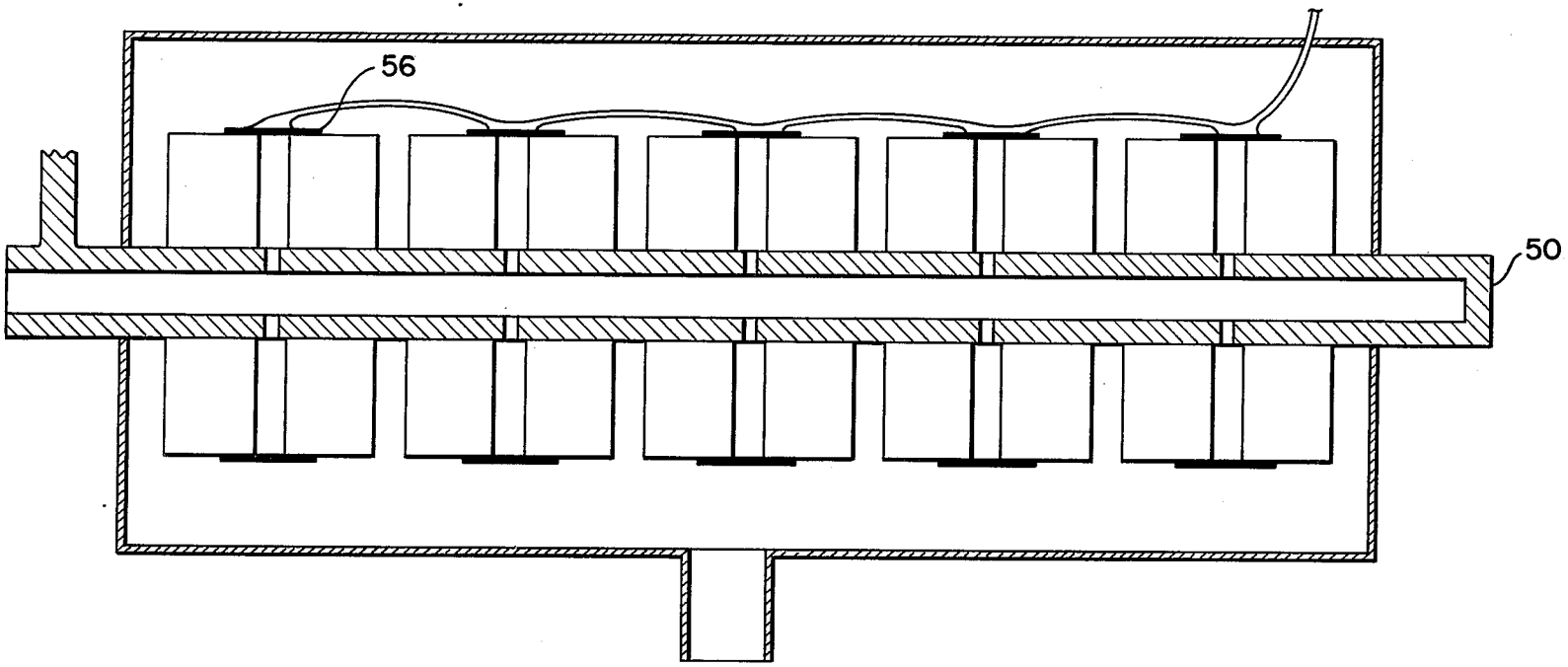
FIG. 11 shows a schematic representation of one form of electrical connection of the elctrochemical cell of FIG. 9.

Embodiment 1 (FIG. 9, 10, 11):

FIG. 9 shows an electrochemcial cell comprising a number of electrode rolls 43 arranged on the axle 51. FIG. 9 shows a cell with 10 electrode rolls. This number is just an example. However, an even number will usually be employed. The main features of this embodiment are as follows:

The axle of the cell is hollow, e.g. a pipe. The electrode rolls 43 are of the type described above with reference to FIG. 2. The electrode rolls are arranged in pairs 52 with a gap 53 between them. In operation, the electrolyte is fed into the gap 53 of each pair of electrode rolls through orifices 54 of the axle 51. The gap 53 is wide enough to enable convenient flow of electrolyte between the electrode rolls forming a pair. The electrolyte is prevented from exiting directly into the space 55 surrounding the core of the cell by a leak-proof metallic band 56 which joins together the electrode rolls forming a pair. The electrode is thus forced to flow through each pair 52 of electrode rolls, that is, through the cavities 7 (see FIG. 3) within the electrode arrangement. After flowing through the electrode rolls, the electrolyte exits from the cell by running through gaps 57 between adjacent pairs of electrode rolls into the space 55 surrounding the core of cell and out by an outlet 58. Electrical connection to the row of electrode rolls can be either parallel or series. In FIG. 9 the series connection is shown. Power is fed to the two end rolls 41, 43 only in one case the electricity being fed to the anode and in the other case to the cathode. The electricity is fed from the power source through bus-bars 59, 60 to isolated metal sections 61, 62 of the axle 51, which act as current feeders to the two end rolls. The rolls which form a pair are electrically connected together by the metallic bands 56, and the rolls of different pairs are connected by isolated conduction sections 63 of the axle. FIG. 11 shows the parallel electrical connection of the electrode rolls. In this case, the axle 51 comprises a continuous electrical conductor 50 which makes electrical connection with one electrode of each roll and the metal bands 56 act as the current feeders to the other electrodes.

The materials and construction of each roll are as described previously and illustrated by FIGS. 1, 2, 3, 4. The use of a bipolar arrangement as shown in FIG. 7 is also possible.

With this first embodiment, the above design aims (a–d) when making an electrochemical cell can be achieved as follows:

Aim (a) is achieved by the use of several electrode rolls. Aim (b) is achieved by the use of a hollow axle with orifices to distribute the electrolyte into the rolls. Aim (c) is achieved by eliminating the need to have a tight fitting metal container for the rolls. Aim (d) is achieved by constructing a large capacity cell from many small units of the same type.

Figure 12A:
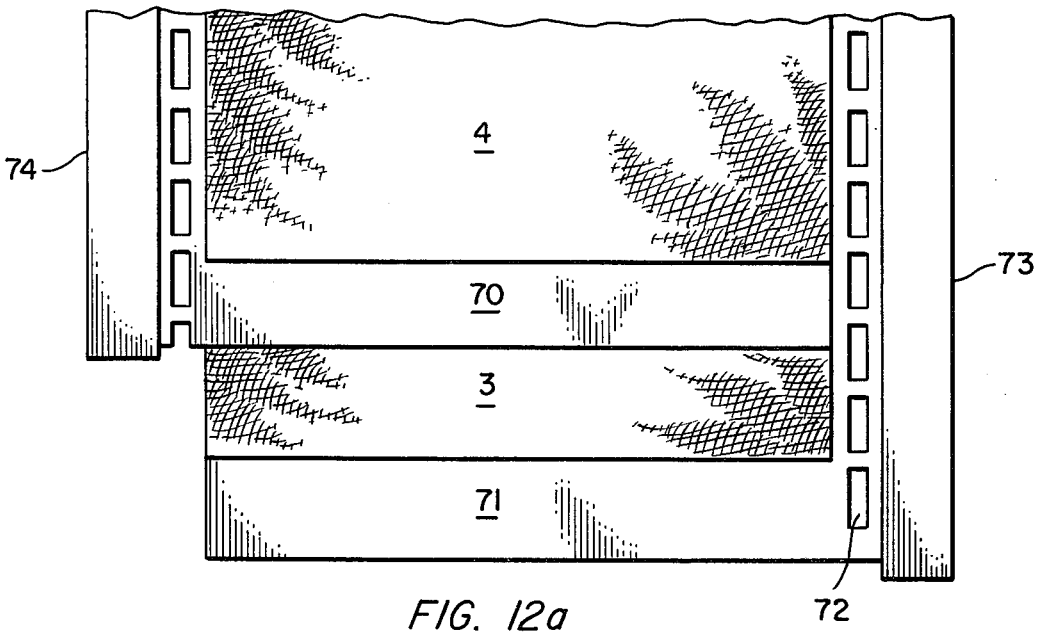
FIG. 12 shows a schematic top view and a schematic cross-section of the electrode arrangement (prior to rolling it) which is used in a second embodiment of an electrochemical cell.
Figure 12B:
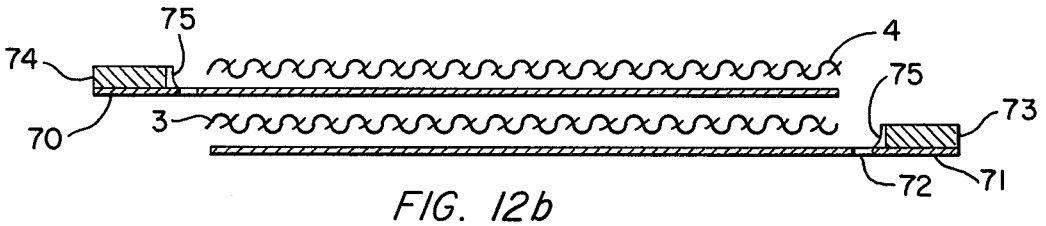
Figure 14:
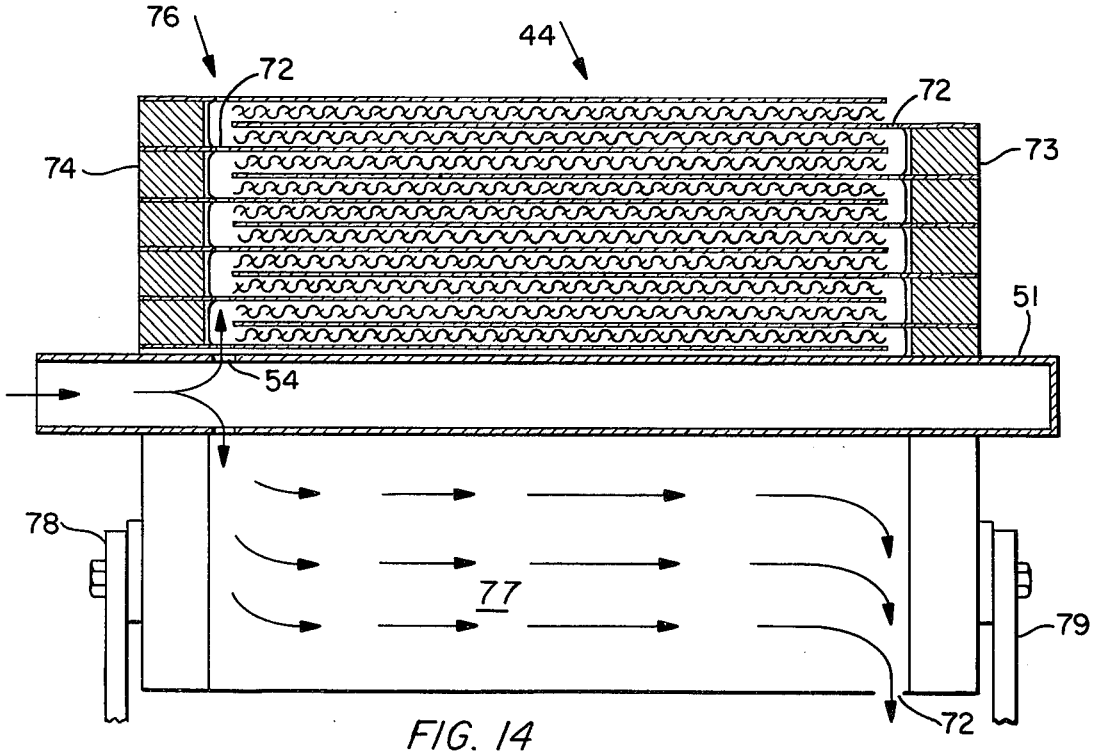
FIG. 14 shows a schematic cross-section of the electrode roll of FIG. 13.
Figure 13:
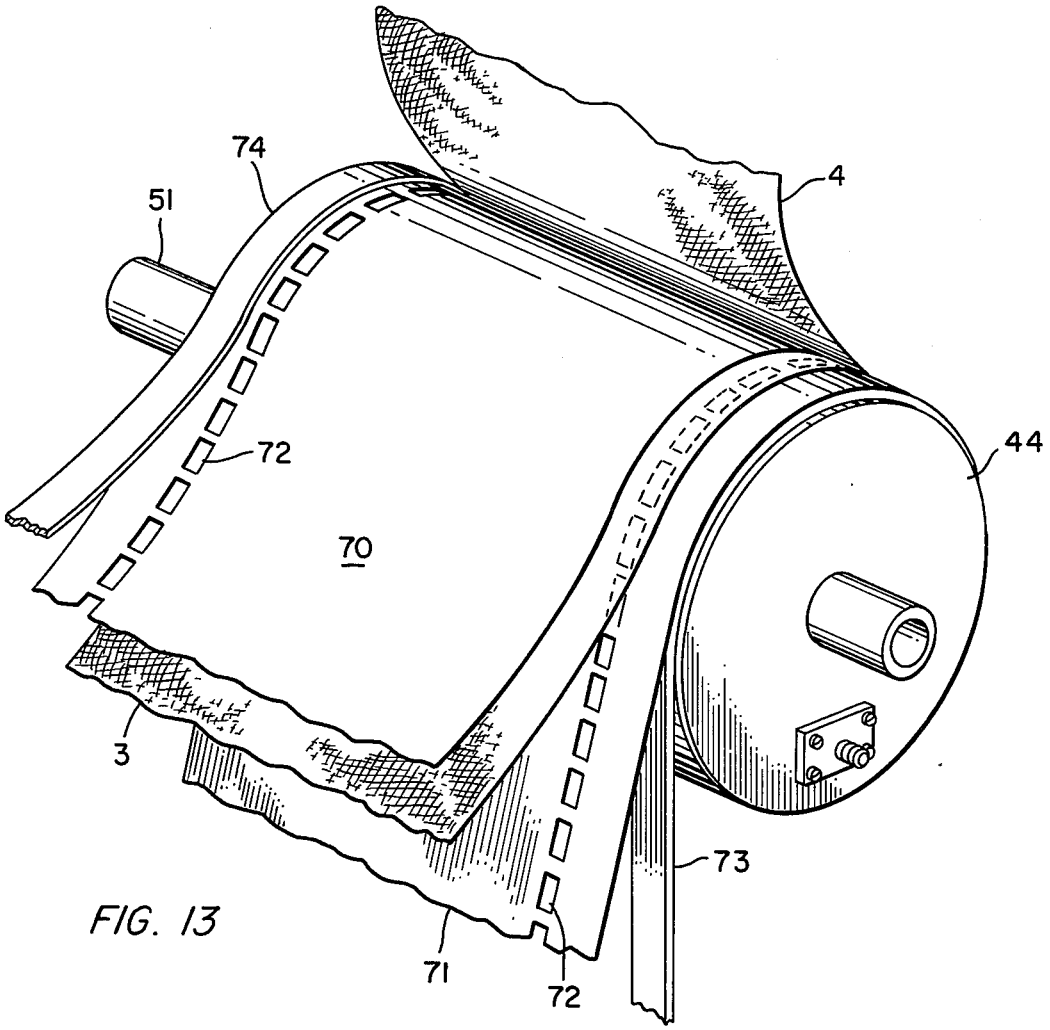
FIG. 13 shows a perspective view of an electrode roll made by rolling up the electrode arrangement of FIG. 12.

Embodiment 2 (FIGS. 12, 13, 14, 17*a*):

Referring to FIG. 14 it can be noticed that like in Embodiment 1, the electrolyte is introduced in the electrode cell 44 of the cell through orifices 54 of the axle 51. The electrode arrangement used for this Embodiment is shown in FIG. 12. It comprises 6 elements: a cathode 70 and an anode 71 both using an electrode material with perforations 72 at one side; two insulating means 3, 4 and two end sealing strips 73, 74. The end sealing strips are constructed from an electrically conducting material (e.g. metal). A sealing compound or aid 75 can also be used to improve the seal. The necessary overlapping of the layers is shown in FIG. 12 which incudes both a top view and a cross-section of the electrode arrangement prior to rolling it. FIG. 13 shows the electrode arrangement of FIG. 12 being rolled up around the axle 51. The metal strips 73, 74 are of a suitable thickness so that the ends of the roll are solid with no possibility of a leak of electrolyte from within the roll. As shown in FIG. 14, the electrolyte is pumped into the roll through the holes 54 in the axis and the perforations 72 of one of the electrode sheets. The electrolyte is prevented from exiting directly from the cell by closing off the path provided through the perforations 72 at the surface of the electrode roll with some leak-proof seal 76. The electrolyte flow path 77 goes through the roll to the other end where it is free to exit through the perforations 72 of the other electrode.

The electrical connection to the electrode roll is made by mounting the bus-bars directly onto the ends of the electrode roll as in 78, 79. These provide connection to the complete longitudinal edge of each electrode. This enables an almost limitless scale-up of the length of the electrodes and of the diameter of the electrode roll.

The materials for making the electrode roll of FIG. 13 are as follows:

The materials for the insulating means 3, 4 are as described previously. Th electrodes are sheet form using materials as described above. An important difference however is the introduction of a row of perforations 72 along one side and over the whole length of each electrode. The perforations 72 of the electrode sheets act as openings for distributing the electrolyte from the hollow axis into the electrode roll. The perforations 72 of one electrode serve as inlets and the perforations 72 of the other electrode as outlets. The position of the electrode roll on the axle 51 enables an easy flow of the electrolyte through the orifices 54 of the axle and through the inlet perforations 72.

A sealing strip 73, 74 is incorporated in the electrode arrangement at both sides. It must be constructed from an electrically conducting material that does not corrode and is electrolyte impermeable. The sealing strip is about the thickness of two layers of insulating material plus one layer of elelctrode material. The sealing strip acts as a means of conducting the electricity across the ends of the roll making contact with the whole side of one particular electrode and as a means of stopping axial electrolyte flow out through the ends of the roll.

With this second embodiment, the above design aims (a–d) when making an electrochemical cell are achieved as follows:

Aim (a) is achieved by the form of power feeding employed, which enables use of electrodes of almost unlimited length for making the electrode roll, that is, the diameter of the roll can also be scaled-up, almost at will. This makes possible an almost limitless scale-up of the reactor current with a single electrode roll, rather than with a plurality of them, as in Embodiment 1. Aim (b) is achieved through the use of a hollow axis with perforations and perforated electrode sheets. Aim (c) is achieved since the bulk of the construction materials are the electrodes themselves. Aim (d) is achieved by the use of simple winding equipment for making the cell.

Embodiment 3 (FIGS. 15, 16, 17*a,* 17*b*):

This is a modification of Embodiment 2, wherein the main features of Embodiment 2 are retained, but in addition the electrode arrangement used is a much broader one and incorporates several bipolar electrode sheets placed side by side so as to enable scale up of the cell voltage as well as of the current. This third Embodiment achieves the design aims as Embodiment 2 and in addition makes possible scale-up of cell voltage also [Aim (a)].

Figure 17A:
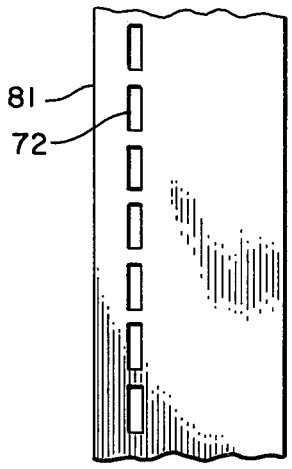
Figure 17B:
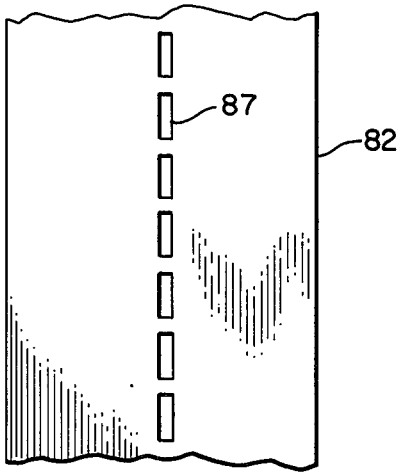
Figure 15:
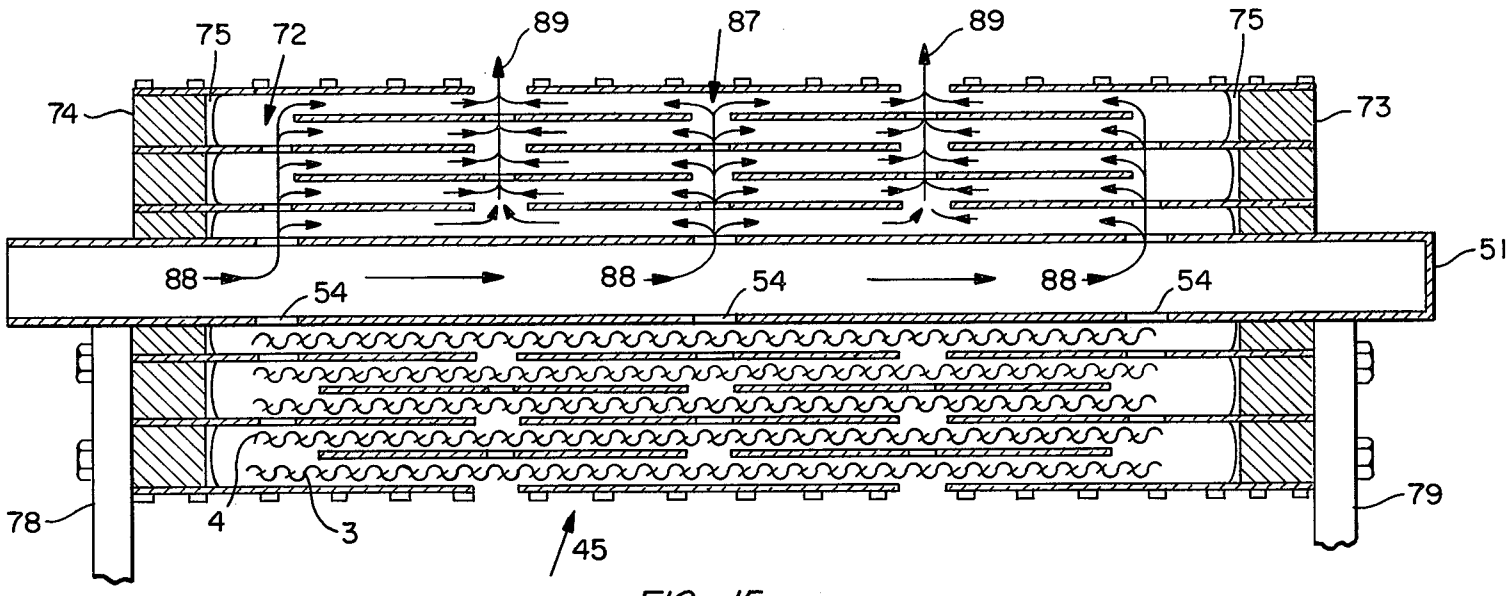
FIG. 15 shows a schematic cross-section of the bipolar electrode arrangement which is used in a third embodiment of an electrochemical cell.
Figure 16:
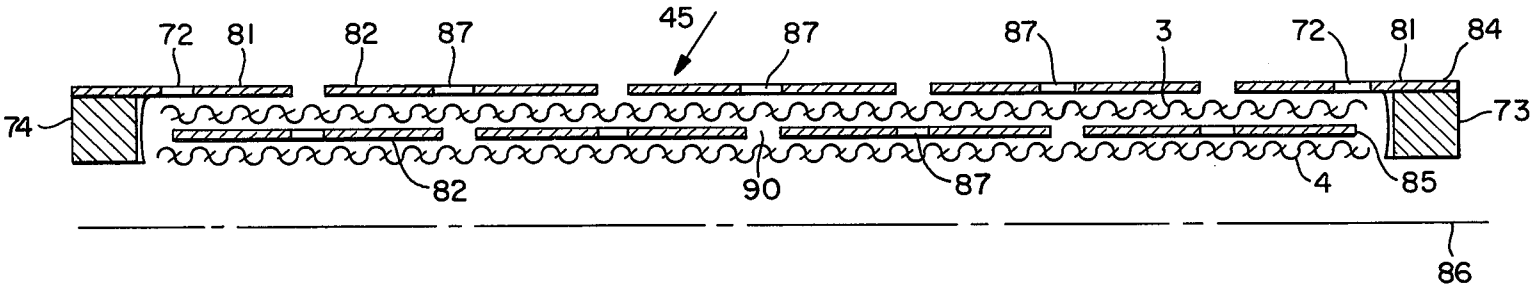
FIG. 16 shows a schematic cross-section which illustrates in detail the structure of the electrode arrangement of FIG. 15, FIG. 17*a*, 17*b* show a top view of the electrode strips employed for making the electrode arrangement shown in FIG. 15 and 16. The electrode strip of FIG. 17*a* is also employed for making be electrode arrangement shown in FIGS. 12, 13, 14.

Referring to FIG. 15, it can be seen that like in Embodiments 1 and 2 the axle 51 of the cell is hollow. The electrolyte is pumped in an electrode roll 45 through perforations 54 of the axle 51 and through perforations (72, 87) of the electrodes. The electrode arrangement used for this embodiment is illustrated by FIGS. 15 and 16. The electrode roll 45 has four layers, which are rolled up around the axle 51, the position of which is indicated by line 86 in FIG. 16. The insulating means 3, 4 are as described previously. One of the electrode layers 84 is constructed from N electrode sheets 82 placed side by side with uniform spaces 90 between them and two end electrode sheets 81. The other electrode layer 85 consists of N+1 electrode sheets 82, which are also placed side by side with uniform spaces 90 between them. The sheets of one electrode layer are placed so as to overlap two halves of adjacent sheets of the other layer. This overlap is shown in FIG. 16 and is necessary for the bipolar operation of each electrode sheet. As shown by FIGS. 16 and 17*a,* 17*b,* the end electrode sheets 81 of the widest electrode layer 84 have slots 72 along one side so as to allow the circulation of electrolyte. The other sheets 82 of the electrode layer 84 are broader (about 2 times the width of 81) and have perforations 87 down their center area and over their whole length. As shown by FIG. 15, the perforations 72, 87 of the sheets of the wider electrode layer 84 lie facing the orifices 54 along the axis 51. This enables flow of the electrolyte through path 88. The electrolyte exits through outlets 89. Each outlet 89 lies in front of a perforation 87 of the other electrode layer 85. As in Embodiment 2, a sealing and electrically conducting strip 73, 74 completes the electrode arrangement at each end.

The electrical connections to the electrode roll 45 are similar to the ones of Embodiment 2, the electricity being fed directly only to the side-most electrode sheets. The other sheets acting in a bipolar fashion transfer the electricity through the electrode arrangement.

The material for making the electrode arrangement of this third embodiment are similar to the ones described for Embodiment 2, but the electrode sheets for bipolar operation differ from the ones previously described in that the perforations would normally be down the center area of the electrode and distributed along its complete length.

A common feature of all three Embodiments described above is the use of a hollow axis 51 with perforations 54 for feeding the electrolyte into the electrode roll(s). As the axle should not short-circuit electrodes with different potentials, the axle has either to be made of non-conducting material or to have a structure which prevents such short-circuits. The axle 51 can also be constructed in a concentric fashion with the outermost tubes acting as current feeders for the electrodes. Current feeders at different potentials have of course to be electrically insulated from each other. As the axle 51 acts in addition as a means of support for the electrode rolls, it will normally be constructed from materials that are strong enough to support the rolls and also a corrosion resistant material.

It should be clear tht among other electrochemical processes, the elelctrolytical oxidations mentioned above to exemplify use of cell according to FIG. 8 can also be performed with the above Embodiments 1–3 of an electrochemical cell according to the invention.

I claim:

1. An electrode arrangement for electrochemical cells including at least one electrode roll formed by spiralling a deformable sandwich arrangement of electrode layers and spacing layers for preventing direct electrical contact between them, at least one of the spacing layers being ion-permeable and the electrodes and spacing layers having shapes and material structures which co-operate with each other to enable electrolyte flow through the electrode roll, the electrode arrangement being characterized in that the electrode rolls are rolled up around a hollow axle and arranged by pairs, each pair having a gap between the electrode rolls and the hollow axle having orifices which enable electrolyte flow from the interior of the hollow axle into the gap of each pair of electrode rolls.

2. An electrode arrangement according to claim 1 further comprising a leak-proof band around each pair of electrode rolls, for closing the gap between the electrode rolls, whereby the whole of the electrolyte flowing into the gap is forced to flow through the electrode rolls.

3. An electrode arrangement for electrochemical cells including at least one electrode roll formed by spiralling a deformable sandwich arrangement of electrode layers and spacing layers for preventing direct electrical contact between them, at least one of the spacing layers being ion-permeable and the electrodes and spacing layers having shapes and material structures which co-operate with each other to enable electrolyte flow through the elelctrode roll, the electrode arrangement being characterized in that the electrode roll is rolled up around a hollow axle, the hollow axle and the electrodes having each orifices at specified positions, which orifices co-operate with each other for enabling electrolyte flow from the interior of the hollow axle into the electrode roll, the position of the orifices being so specified that the electrolyte flows first in a direction perpendicular to the axle and then parallel thereto.

4. An electrolyte arrangement for electrochemical cells according to claim 3 wherein the electrode roll includes at least one pair of electrode layers for bipolar operation, each of which is composed of a plurality of perforated electrode strips, which are rolled around the axle in spaced relationship, each strp of one electrode layer overlapping approximately two halves of adjacent strips of the oter electrode layer.

5. An electrode arrangement for electrochemical cells including at least one electrode roll formed by spiralling a deformable sandwich arrangement of electrode layers and spacing layers for preventing direct electrical contact between them, at least one of the spacing layers being ion-permeable and the electrodes and spacing layers having shapes and material structures which co-operate with each other to enable electrolyte flow hrough the electrode roll, the electrode arrangement being characterized in that for enabling electrical power feed through the axial ends of the electrode roll each longitudinal side of the sandwich arrangment includes a strip-shaped layer of electrically conducting material which overlaps and is in direct electrical contact with one longitudinal edge of one electrode, so that the electrode structure formed by rolling the sandwich arrangement has conducting ends, each end enabling to feed electrical current to the whole length of one electrode layer.

6. An electrode arrangement according to claim 5, wherein the electrically conducting strip-layers are placed on the longitudinal edges of te electrode layers prior to rolling and are rolled with the electrode arrangement for sealing both ends of the electrode roll in axial direction.

7. An electrode arrangement for electrochemical cells including at least one electrode roll formed by spiralling a deformable sandwich arrangement of electrod layers and spacing layers for preventing direct electrical contact between them, at least one of the spacing layers being ion-permeable and the electrodes and spacing layers having shapes and material structures which co-operate with each other to enable elelctrolyte flow through the electrode roll, the electrode arrangement being characterized in that the electrode layers are longitudinally segmented for bipolar operation, each electrode segment of one of the electrode layers overlapping approximately two halves of adjacent segments of the other electrode layer and the end segments of one of the electrode layers having each a terminal for electrical connection; and the insulating means between electrodes that form a pair for bipolar operation enable ionic conduction, whereas the insulating means between different electrode pairs, that is, electrode pairs other than the pair designed to operate together, prevent both ionic and electronic conduction between electrodes of such different pairs.

8. An electrode arrangement for electrochemical cells, comprising a sandwich arrangement of at least two electrodes made from deformable material, wherein the electrodes are longitudinally segmented for bipolar operation, each elelctrode segment of one of the electrode layers overlapping approximately two halves of adjacent segments of the other electrode layer and the end segments of one of the electrode layers having each a terminal for electrical connection, first insulating means for preventing direct electrical contact between the electrodes, second insulating means for preventing direct electrical contact between one of the electrodes and other electrodes or other conducting parts of the electrochemical cell, the insulating means between electrodes that form a pair for bipolar operation enabling ionic conduction, whereas the insulating means between different electrode pairs, that is, electrode pairs other than the pair designed to operate together, prevent both ionic and electronic conduction between electrodes of such different pairs, the sandwich arrangement of electrodes and insulating means forming a deformable electrode arrangement, and the electrodes and the insulating means having shapes and material structures which co-operate with each other to enable the flow of an electrolyte through the electrode arrangement.

9. An electrode arrangement for electrochemical cells, comprising a sandwich arrangement of at least two electrodes made from deformable material, first insulating means for preventing direct electrical contact between the electrodes and second insulating means for preventing direct electrical contact between one of the electrodes and other electrodes or other conducting parts of the electrochemical cell, said sandwich arrangement being rolled up around a geometrical axis to form an electrode roll, at least one of said electrode rolls being rolled up around a hollow axle, said electrode roll further comprising electrically conducting sealing strips placed on one longitudinal edge of each electrode prior to rolling and rolled with the electrode arrangement for sealing both ends of the electrode roll in axial direction, the electrodes of said electrode roll having perforations and said hollow axle having orifices at certain positions whereby to enable the electrolyte to flow from the interior of the hollow axle through the orifices of the hollow axle into the electrode roll in a direction perpendicular to the axle, said sandwich arrangement of electrodes and insulating means forming a deformable electrode arangement, and the electrodes and the insulating means, as aforesaid, having shapes and material structures which co-operate with each other to enable the flow of an electrolyte through the electrode arrangement.

10. An electrode arrangement for electrochemical cells, comprising a sandwich arrangement of at least two electrodes made from deformable material, first insulating means for preventing direct electrical contact between the electrodes and second insulating means for preventing direct electrical contact between one of the electrodes and other electrodes or other conducting parts of the electrochemical cell, said sandwich arrangement being rolled up around a geometrical axis to form an electrode roll, at least one of said electrode rolls being rolled up around a hollow axle, the electrode roll including at least one pair of electrode layers for bipolar operation, each of which is composed of a plurality of perforated electrode strips, which are rolled around the axle in spaced relationship, each strip of one electrode layer overlapping approximately two halves of adjacent strips of the other electrode layer, said electrode roll having perforations and said hollow axle having orifices at certain positions whereby to eanble the electrolyte to flow from the interior of the hollow axle through the orifices of the hollow axle into the electrode roll in a direction perpendicular to the axle, said sandwich arrangement of electrodes and insulating means forming a deformable electrode arrangement, and the electrodes and the insulating means, as aforesaid, having shapes and material structures which co-operate with each other to enable the flow of an electrolyte through the electrode arrangement.

* * * * *